US009556741B2

(12) United States Patent
Plante et al.

(10) Patent No.: US 9,556,741 B2
(45) Date of Patent: Jan. 31, 2017

(54) SHROUDED BLADE FOR A GAS TURBINE ENGINE

(71) Applicant: Pratt & Whitney Canada Corp., Longueuil (CA)

(72) Inventors: Ghislain Plante, Verdun (CA); Remy Synnott, St-Jean-sur-Richelieu (CA); Jaideep Gahlawat, Brossard (CA)

(73) Assignee: PRATT & WHITNEY CANADA CORP, Longueuil, QC (CA)

( * ) Notice: Subject to any disclaimer, the term of this patent is extended or adjusted under 35 U.S.C. 154(b) by 422 days.

(21) Appl. No.: 14/179,836

(22) Filed: Feb. 13, 2014

(65) Prior Publication Data

US 2015/0226070 A1 Aug. 13, 2015

(51) Int. Cl.
*F01D 5/22* (2006.01)

(52) U.S. Cl.
CPC ..... *F01D 5/225* (2013.01)

(58) Field of Classification Search
CPC ..... F01D 5/20; F01D 5/12; F01D 5/14; F01D 5/225; F01D 5/22
USPC ..... 416/189, 190, 191, 192
See application file for complete search history.

(56) References Cited

U.S. PATENT DOCUMENTS 6,491,498 B1 12/2002 Seleski et al.
7,001,152 B2 * 2/2006 Paquet ..... F01D 5/225 29/889.21
7,066,714 B2 * 6/2006 Miller ..... F01D 5/225 415/173.6
7,527,477 B2 * 5/2009 Norton ..... F01D 5/225 29/889.2
8,047,793 B2 * 11/2011 Baumas ..... F01D 5/147 416/191
9,103,218 B2 * 8/2015 Pikul ..... F01D 5/225
9,322,281 B2 * 4/2016 Schlemmer ..... F01D 5/225
2012/0003078 A1 * 1/2012 Pikul ..... F01D 5/225 415/173.1
2012/0070309 A1 3/2012 Zambetti et al.
2012/0107123 A1 * 5/2012 Schlemmer ..... F01D 5/225 416/191

FOREIGN PATENT DOCUMENTS

JP H10306702 11/1998
JP 2005207294 8/2005

* cited by examiner

*Primary Examiner* — Jason L Vaughan
(74) *Attorney, Agent, or Firm* — Norton Rose Fulbright Canada LLP

(57) ABSTRACT

A turbine blade for a gas turbine engine comprises a platform, a blade root, an airfoil portion defining pressure and suction sides, and a shroud provided at a tip of the airfoil portion opposite to the blade root. The shroud includes a body having a radially outer face opposite to the airfoil portion, upstream and downstream generally parallel fins extending outwardly from the outer face, and two ribs extending outwardly from the outer face. Each of the fins has an end disposed toward the pressure side and another end disposed toward the suction side. The ribs extend from and connecting the upstream fin to the downstream fin at locations other than the ends of the upstream and downstream fins. The ribs converge toward the downstream fin at an angle of between about 10 and about 45 degrees. A shroud for a blade is also presented.

9 Claims, 5 Drawing Sheets

SHROUDED BLADE FOR A GAS TURBINE ENGINE

TECHNICAL FIELD

The application relates generally to turbines for gas turbine engines and, more particularly, to shrouded blades.

BACKGROUND OF THE ART

Turbine rotors comprise circumferentially-disposed turbine blades extending radially from a common annular hub. Each turbine blade has a root portion connected to the hub and an airfoil shaped portion projecting radially outwardly into the gas path. The turbine blades may have shrouds at the tips of the blades opposite to the roots.

Shrouds are material added to the tips of the blades. The shrouds extend in a plane generally perpendicular to that of the airfoil portion. Shrouds reduce tip leakage loss of the airfoil portion of the blade. However, the addition of the shroud increases the centrifugal load which causes higher stresses in the airfoil. In addition, the tangential extension of the airfoil generates a bending stress at the intersection between the airfoil and the shroud.

SUMMARY

In one aspect, there is provided a turbine blade for a gas turbine engine, the blade comprising: a platform; a blade root extending radially inwardly from the platform; an airfoil portion extending radially outwardly from the platform, the airfoil portion defining a pressure side and a suction side of the turbine blade; and a shroud provided at a tip of the airfoil portion opposite to the blade root, the shroud including: a body having a radially outer face opposite to the airfoil portion; upstream and downstream fins extending outwardly from the outer face, the fins being generally parallel to each other, each of the fins having an end disposed toward the pressure side and another end disposed toward the suction side; two ribs extending outwardly from the outer face, the ribs extending from and connecting the upstream fin to the downstream fin at locations other than the ends of the upstream and downstream fins, the ribs converging toward the downstream fin at an angle of between about 10 and about 45 degrees.

In another aspect, there is provided a shroud for a blade, the shroud comprising: an elongated body having an outer face; first and second fins extending outwardly from the outer face, the fins being generally parallel to each other and in a direction of elongation of the body; two ribs extending outwardly from the outer face, the ribs extending from and connecting the first and second fins at locations other than ends of the first and second fins, the ribs converging toward the second fin at an angle of between about 10 and about 45 degrees.

DESCRIPTION OF THE DRAWINGS

Reference is now made to the accompanying figures in which.

DETAILED DESCRIPTION

Figure 1:
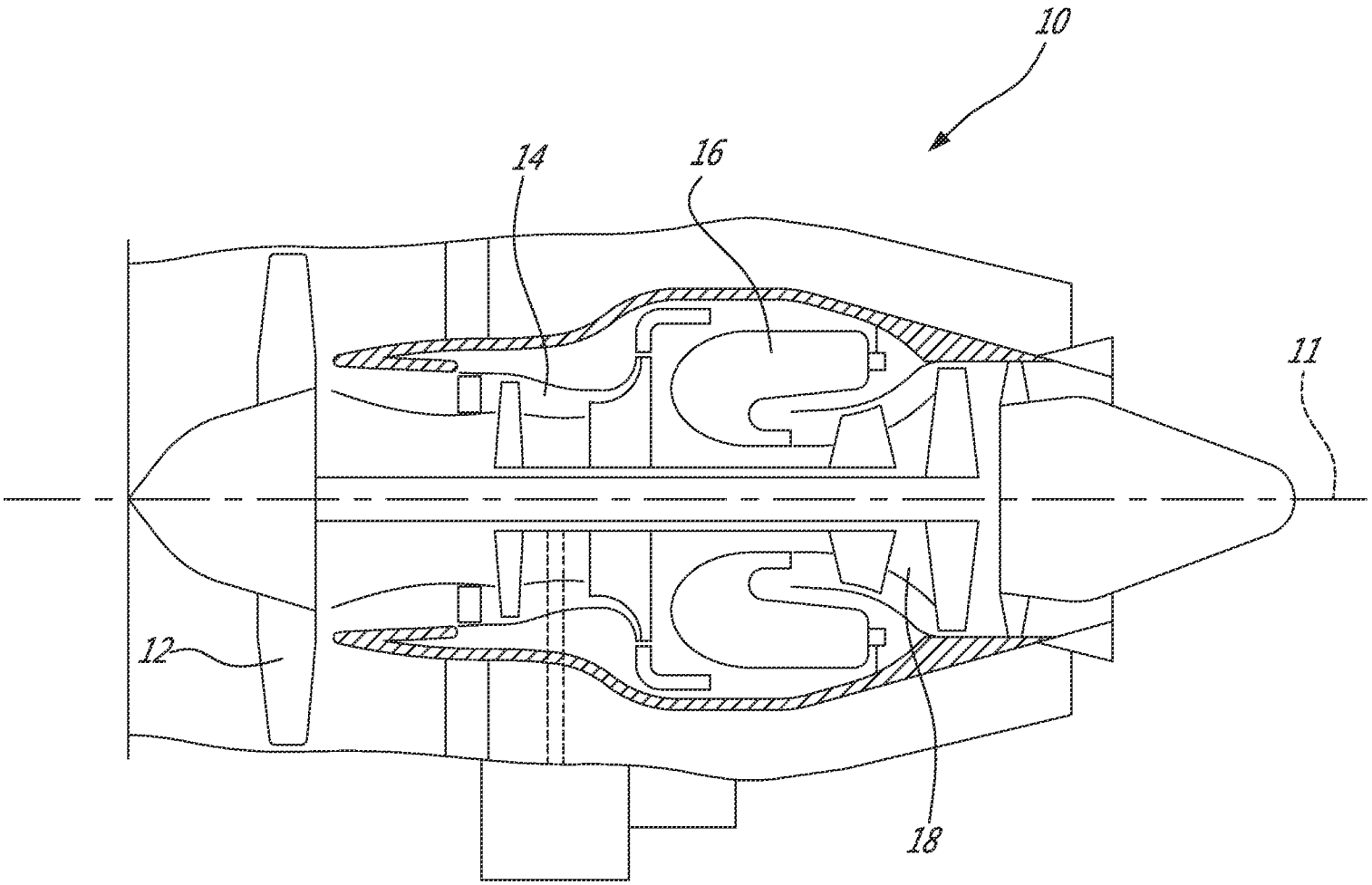
FIG. 1 is a schematic cross-sectional view of a gas turbine engine.

FIG. 1 illustrates a gas turbine engine 10 of a type preferably provided for use in subsonic flight, generally comprising in serial flow communication within a casing 13 a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has a longitudinal central axis 11.

Figure 2:
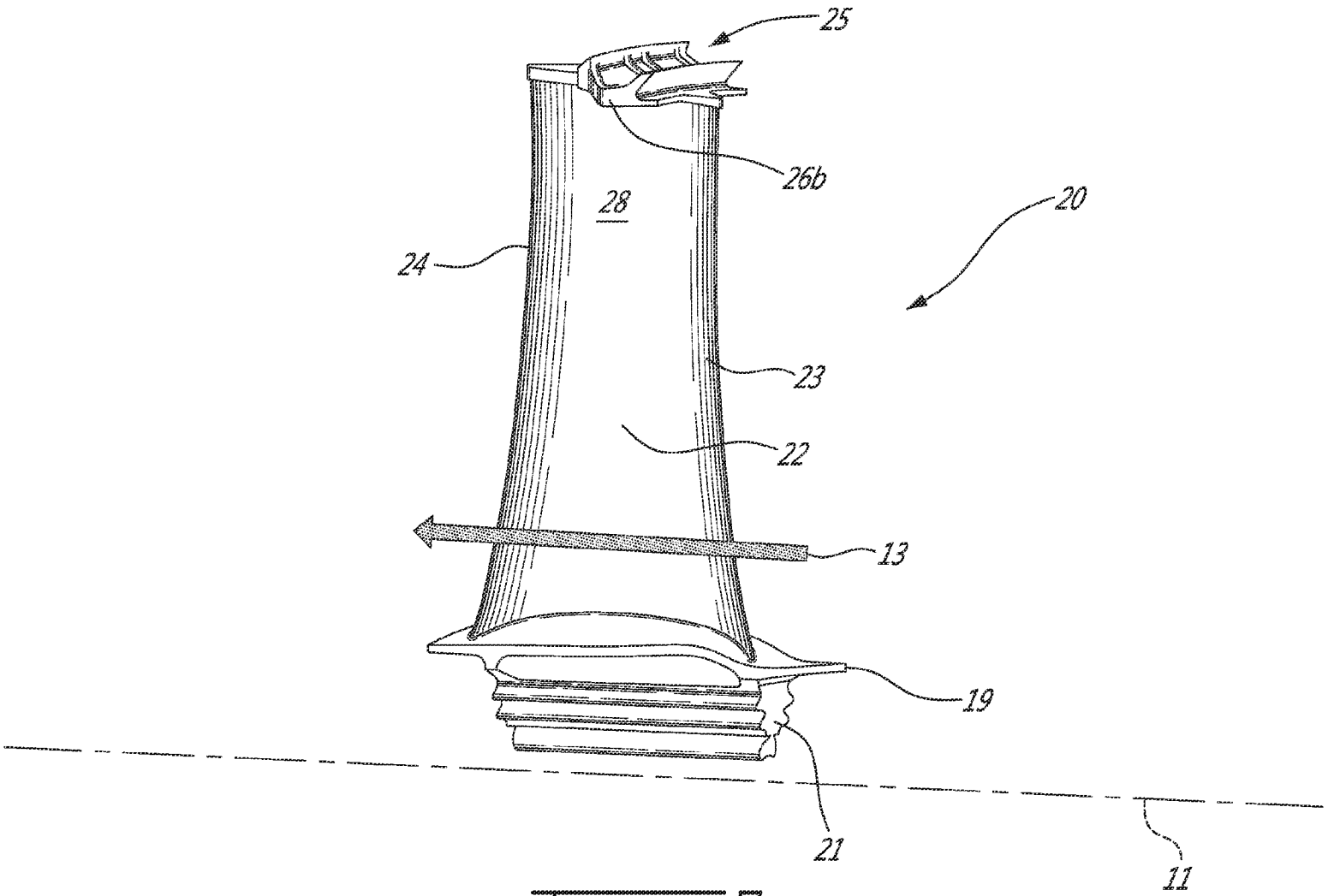
FIG. 2 is an isometric view of a turbine blade of a gas turbine engine such as the one of FIG. 1.

Turning now to FIG. 2, the turbine section 18 includes at least one, but generally a plurality of turbine rotors (not shown). The turbine rotors each comprise an annular hub (not shown) and a plurality of circumferentially-disposed turbine blades 20 attached thereto. The turbine blades 20 extend radially relative to the longitudinal central axis 11 which additionally defines a central axis of the turbine rotors.

Each turbine blade 20 has a root portion 21 depending from a platform 19, an airfoil portion 22 extending radially outward from the platform 21, and a shroud portion 25 provided at an outer radial end 26*b* or tip of the airfoil portion 22. The root portion 21 of each turbine blade 20 is received with correspondingly-shaped firtree slots in the annular hub of the turbine rotor. The root portion 21 shown in FIG. 3 is only one example of root portion 21 usable with the blade 20.

The airfoil portion 22 of the turbine blade 20 extends into a gas path accommodating the annular stream 13 of hot combustion gases generated by the combustor 16, the hot combustion gases acting on the airfoil portion 22 of the turbine blades 20 and causing the turbine rotor 20 to rotate. The airfoil portion 22 of the turbine blade 20 includes a leading edge 23 and a trailing edge 24, the trailing edge 24 being positioned further aft longitudinally than the leading edge 23. The airfoil portion 22 of the turbine blade 20 is cambered (i.e. curved camber line) as is typical in the art of turbine blade airfoils. The airfoil portion 22 includes a pressure side 28 having a generally concave shape, and a suction side 29 located opposite the pressure side 28, the suction side 29 having a generally convex shape. In the embodiment shown herein, the airfoil portion 22 is twisted along its length (i.e. along a radial direction when disposed in the turbine 18). It is contemplated that the airfoil portion 22 could not be twisted.

Figure 3:
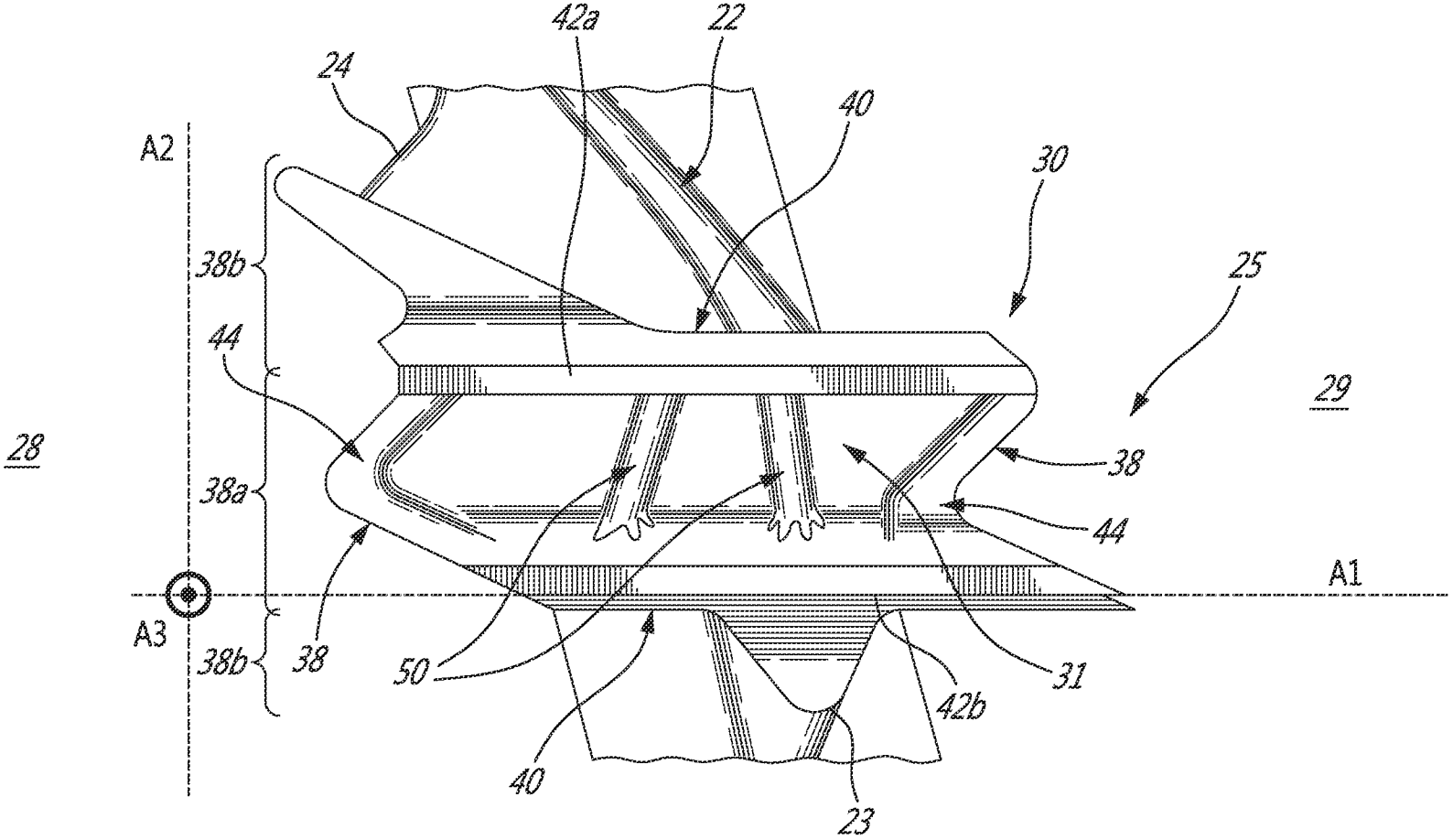
FIG. 3 is a top plan view of a shroud of the blade of FIG. 2.
Figure 4:
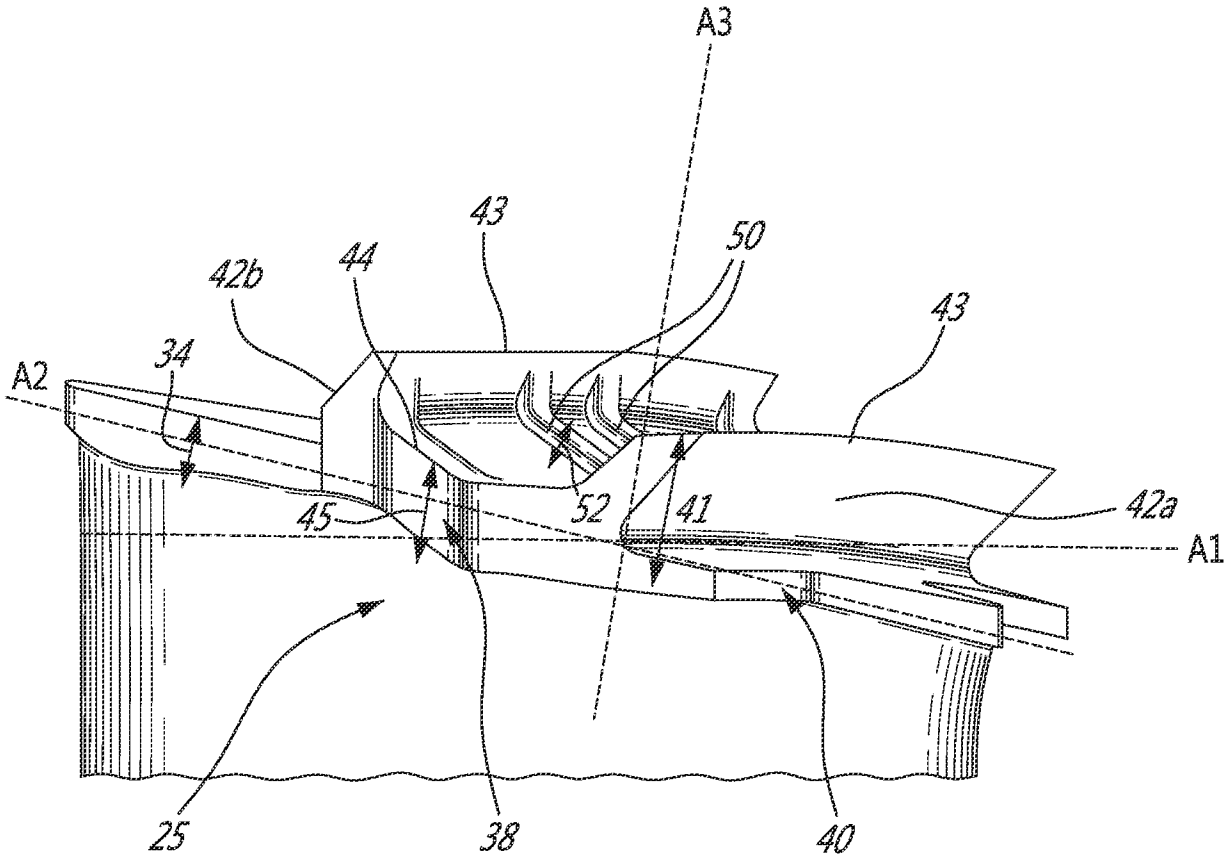
FIG. 4 is an isometric view of the shroud of FIG. 3.

Turning now to FIGS. 3 and 4, the shroud 25 will now be described. The shroud 25 is integrally formed with the airfoil portion 22 of the turbine blade 20, and covers and extends beyond the outer end 26*b* of the airfoil portion 22.

The shroud 25 comprises a generally planar prismatic body 30 onto which a local coordinate axis will be defined for the purposes of this description. A first axis A1 is parallel to the longitudinal axis 11. A second axis A2 is orthogonal to the axis A1 and in plane with the body 30. A third axis A3 is orthogonal to the axes A1 and A2 and is normal to the body 30. The axis A3 is in the radial direction relative to the longitudinal axis 11. It should be understood that the shroud 25 is not exactly planar nor prismatic (i.e. flat), since it is a body of revolution which forms an annulus (or portion thereof) about a center point (e.g. the rotor axis). However for convenience the shroud 25 is described herein as "generally planar".

The body 30 has a nominal thickness 34 (in the direction of the axis A3, shown in FIG. 4). It is contemplated that the body 30 could have a locally increased thickness in a portion adjacent the airfoil portion 22 to address bending stresses induced by a radial deflection of the shroud 25 the resultant of the rotation speed.

The body 30 includes a pair of opposed bearing faces 38 generally oriented along the axis A2. The bearing faces 38 are adapted for abutment with similar bearing faces of adjacent shrouded blades. The two bearing or contact faces 38 have each a contacting portion 38*a* (a.k.a. interlock face) disposed between two non-contacting portions 38*b*. The bearing faces 38 have a generally Z-shape. The shroud 25 also includes a pair of opposed and generally parallel non-bearing faces 40 joining the bearing faces 38. The non-bearing faces 40 are generally orientated along the axis A2.

Two fins (also sometimes referred as knife edges), namely an upstream fin 42*b* and a downstream fin 42*a*, project radially outwardly (direction A3) from an outer face 31 of the shroud body 30 opposite to the hot gas path. As such, the fins 42*a,b* have a height 41 in a direction of the axis A3 (shown in FIG. 4) larger than the nominal thickness 34 of the body 30. Having a thinner structure between the fins 42*a,b* allows minimising the bending stress and weight of the shroud 25. The fins 42*a,b* extend across the body 30 of the shroud 25 from one bearing face 38 to the other. The fins 42*a,b* are generally straight and parallel to each other and disposed generally along the axis A1. The fins 42*a,b* help provide a blade tip seal with the surrounding shroud ring providing stiffening rails which help resist "curling" or centrifugal deflection of the turbine blade shroud 25. The fins 42*a,b* have a pointy end 43 and are inclined relative to the axis A3 in a direction opposite to a direction 13 of the flow. It is contemplated that the fins 42*a,b* could be straight instead of being inclined. It is believed that inclined fins would be less stiff than vertical fins, which in turn would increase a radial deflection of the fin and stresses at the interface between the airfoil portion 22 and the shroud portion 25 of the blade 20. However the inclination of the fins 42*a,b* described herein allows generating a secondary flow that acts as an artificial gas wall against the main flow above the shroud 25.

Two outer ribs 44 extend radially outwardly from the face 31 of the shroud body 30 at both ends thereof, in a manner such that the outer ribs 44 are part of the bearing faces 38. The outer ribs 44 extend between the two parallel fins 42*a,b*. Each outer rib 44 connects one end of one of the fins 42*a,b* to an opposed end of the other one of the fins 42*a,b*. The outer ribs 44 preferably have a substantially constant height 45 in a direction of the axis A3 (shown in FIG. 4) greater than the nominal thickness 34 of the shroud body 30. The height 45 of the outer ribs 44 is preferably shorter than the height 41 of the fins 42*a,b* but could have similar height. The height 45 is normally minimised in order to reduce the weight and to reduce the shroud 25 deflection. The outer ribs 44 provide an increased area to bearing faces 38, which in turn reduces the contact stresses which arise from contact with mating bearing faces of adjacent turbine blades 20. The height 45 is selected to cater the shroud 25 interlock bearing stress and load requirement with respect to all adverse manufacturing tolerance effects. The shroud's 25 interlock face 38*a* requires an optimal contact face area in order to provide an appropriated dynamic damping response and affect the structure stiffness behavior. The contact face area is defined as the height 45 of the outer rib 44 times a length of the edge between the interlock face 38*a* and the outer face 31.

The shroud 25 includes two inner ribs 50 extending outwardly from the face 31 of the shroud body 30. The inner ribs 50 increase stiffness of the shroud 25. The inner ribs 50 allow obtaining lower stresses at the airfoil portion 22 to shroud portion 25 intersection, so the variable fillet normally used in this area could be minimized, thereby reducing flow disturbances.

The inner ribs 50 are disposed between the two outer ribs 41. The inner ribs 50 extend between the two parallel fins 42. As best shown in FIG. 4, a height 52 of the inner ribs 50 along the axis A3 is shorter than that of the fins 42*a,b*. Although the height 52 of the inner ribs 50 is shown as equal to the height 45 of the outer ribs 44, it is contemplated that the inner ribs 50 could be height is completely independent to the outer ribs 44 height. The height 52 of the inner ribs 50 is considered to be smaller than the fins 43 height. It was found that in the case of the optimum shroud design in term of weight and stress, the height 52 must be smaller to the fins 43 height. The thickness (width in the direction A1) of the ribs 50 could be to a minimum castability limit but it is desirable to have a width proportional to the rib height 52. This gives the optimum stiffening effect.

Figure 5:
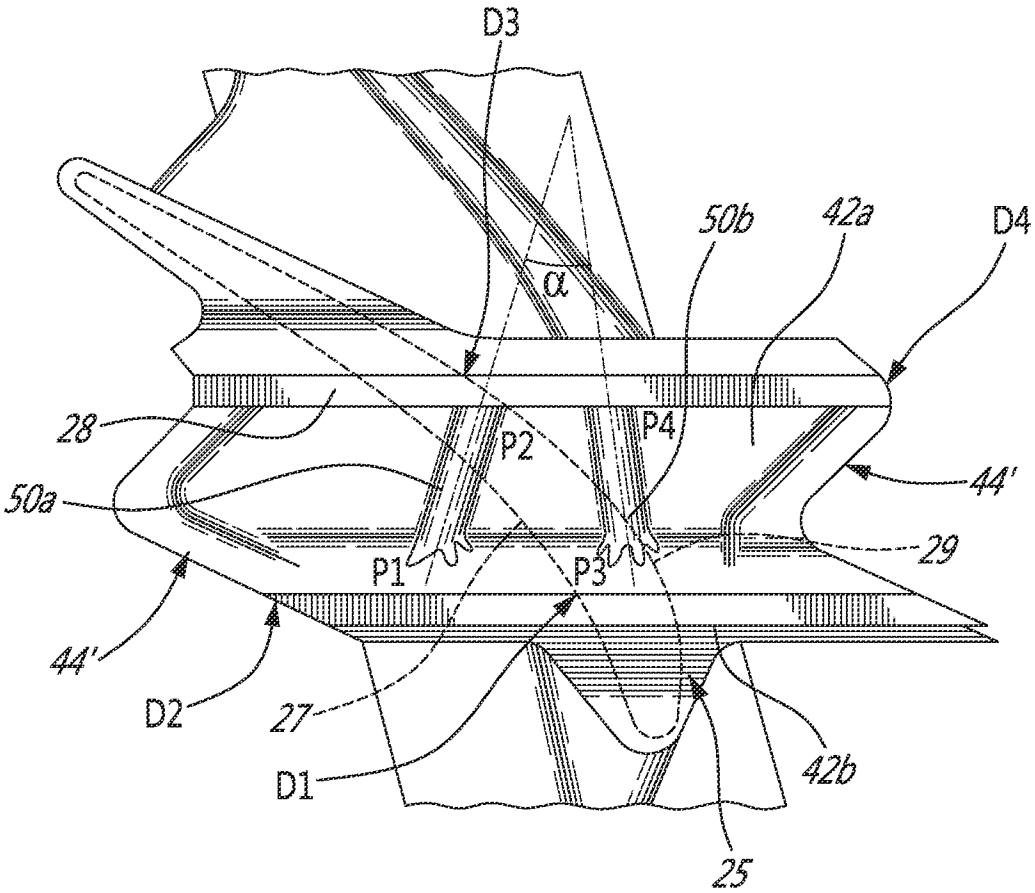
FIG. 5 is a top plan view of a shroud of the blade of FIG. 2 shown with a superimposed cross-section of an airfoil portion of the blade.

Referring to FIG. 5, it can be seen that the inner ribs 50 include a first inner rib 50*a* and a second inner rib 50*b*. The first inner rib 50*a* is disposed toward the pressure side 28, and the second inner rib 50*b* is disposed toward the suction side 29. The first inner rib 50*a* and the second inner rib 50*b* are not parallel to each other; instead they form an angle $\alpha$ between 10 and 45 degrees. In one embodiment, the inner rib 50*a* and the second inner rib 50*b* form an angle $\alpha$ between 20 and 30 degrees. In one embodiment, the inner rib 50*a* and the second inner rib 50*b* form an angle of 26 degrees. Tests have shown that non parallel inner ribs 50 forming an angle $\alpha$ greater than 10 degrees provided better stiffening to the shroud 25 than parallel inner ribs.

Still referring to FIG. 5, the shroud 25 is shown with a superimposed cross-section 27 of the airfoil 22 taken at a connection with the shroud 25 (i.e. at end 26*b*). A position of each of the inner ribs 50*a*, 50*b* is determined to minimise bending of the shroud 25.

The first inner rib 50*a* extends from point P1 on the upstream fin 42*b* to point P2 on the downstream fin 42*a*. Points P1 and P2 are not extremities of any of the upstream and downstream fins 42*a,b*.

Point P1 is a point on the upstream fin 42*b* disposed between ¼ and ½ of the distance between D1 and D2 relative to point D1. The point D1 is defined as the point on the upstream fin 42*b* that is vertically aligned with the pressure side 28 of the cross-section 27 of the airfoil 22, i.e. it is the virtual intersection between the upstream fin 42*b* and the pressure side 28 of the cross-section 27 of the airfoil 22. The point D2 is an extremity of the upstream fin 42*b* toward the pressure side 28. Once the distance D1-D2 is known, the point P1 is determined by placing P1 between D1 and D2 at a distance comprised between 25% and 60% of the distance D1-D2 starting from D1. The point P1 is located close or in-line with the maximum deformation location (i.e. flexion point) of the fin 42*b* on the pressure side of the shroud 25. The location of the point P1 relative to the point P2 is determined as a compromise between a shroud weight increase and a stiffening increase. Depending on the shape of the airfoil 22 and on the shroud 25, the point P1 may be desired to be closer to D1 or further away from D1 to provide increased stiffening to the shroud 25.

Point P2 is a point on the downstream fin 42*a* chosen to be vertically aligned with suction side 29 of the cross-section 27 of the airfoil 22, i.e. it is the virtual intersection between the downstream fin 42*a* and the suction side 29 of the cross-section 27 of the airfoil 22. The point P2 corresponds to a region of the shroud 25 where there is no radial deflection of the shroud 25. Although the point P2 location is shown in the drawings to be in-line with the suction side 29 intersection, it is contemplated that the point P2 could be located in-between the virtual intersection of the pressure side 28 with the cross-section 27 of the airfoil 22 and the virtual intersection of the suction side 29 with the cross-section 27 of the airfoil 22. It is believed that the airfoil shape and orientation relative to the direction A2 are dictating the optimum location.

The second inner rib 50*b* extends from point P3 on the upstream fin 42*b* to point P4 on the downstream fin 42*a*. Points P3 and P4 are not extremities of any of the upstream and downstream fins 42*a,b*.

Point P3 is a point chosen to be on the upstream fin 42*b* in between the vertical alignment of the pressure side 28 and the suction side 29 of the cross-section 27 of the airfoil 22. As for the point P2, the point P3 location corresponds to a region of no radial deflection of the shroud 25 relative to the airfoil. At the point P3, the deformation of the fin 42*a* is minimal.

Point P4 is a point on the on downstream fin 42*a* disposed between 25% and 60% of the distance between D3 and D4 relative to point D3. The point D3 is defined as the point on the downstream fin 42*a* that is vertically aligned with the suction side 29 of the cross-section 27 of the airfoil 22, i.e. it is the virtual intersection between the downstream fin 42*a* and the suction side 29 of the cross-section 27 of the airfoil 22. The point D3 corresponds to point P2. The point D4 is an extremity of the downstream fin 42*a* toward the suction side 29. Once the distance D3-D4 is known, the point P4 is determined by placing P4 between D3 and D4 at a distance comprised between 25% and 60% of the distance D3-D4 starting from D3. Depending on the shape of the airfoil 22 and on the shroud 25, the point P4 may be desired to be closer to D3 or further away from D3 to provide increased stiffening to the shroud 25

The inner ribs 50 position, height and width have been optimized to provide adequate stiffness with a minimum weight increase. The local nature of the increase in shroud material via the outer ribs 44 and inner ribs 50 minimizes the overall weight increase. As a consequence, the operational life of the turbine blades 20 can be increased with only a minimal weight trade-off. The outer ribs 44 accordingly reduce contact stress between adjacent blade shrouds 25, thereby minimizing fretting wear on the shroud contact faces 38. Because the outer ribs 44 provide an increased area to the bearing faces 38, contact stresses which arise from contact with mating bearing faces of adjacent turbine blades 20 are reduced compared to blades without the outer ribs 44.

The above description is meant to be exemplary only, and one skilled in the art will recognize that changes may be made to the embodiments described without departing from the scope of the invention disclosed. Although the shroud is shown herein to be used on blades of a turbofan gas turbine engine, it is contemplated that the shroud could be used on blades of other types of gas turbine engines, such as turboshaft, turboprop, or auxiliary power unit. Although the shroud is preferably cast with the rest of the turbine blade as a single element, it is contemplated that the local projections from the body portion of the shroud, such as the fins, the outer ribs, or the find the inner ribs could be incorporated onto existing shrouded turbine blades, to reduce shroud contact face fretting and increase the contact face life. Existing cast shrouded turbine blades could easily include such edge projections, through a relatively minor casting tool change. Further, these edge projections can also be added as a post-production add-on or blade repair process, being added to the turbine shroud using methods which are known to one skilled-in the art, such as braze or weld material build-up or other method. Accordingly the above permits increases to the shroud contact face surface area to reduce contact stress between already-manufactured turbine shrouds. It is contemplated that the shroud could have more than two fins such as the fins described above. It is also contemplated that the shroud could have more than two inner ribs. Still other modifications which fall within the scope of the present invention will be apparent to those skilled in the art, in light of a review of this disclosure, and such modifications are intended to fall within the appended claims.

The invention claimed is:

1. A turbine blade for a gas turbine engine, the blade comprising:

a platform;

a blade root extending radially inwardly from the platform;

an airfoil portion extending radially outwardly from the platform, the airfoil portion defining a pressure side and a suction side of the turbine blade; and a shroud provided at a tip of the airfoil portion opposite to the blade root, the shroud including:

a body having a radially outer face opposite to the airfoil portion;

upstream and downstream fins extending outwardly from the outer face, the fins being generally parallel to each other, each of the fins having an end disposed toward the pressure side and another end disposed toward the suction side;

two ribs extending outwardly from the outer face, the ribs extending from and connecting the upstream fin to the downstream fin at locations other than the ends of the upstream and downstream fins, the ribs converging toward the downstream fin at an angle of between about 10 and about 45 degrees, wherein the ribs include a first rib disposed toward the pressure side and a second rib disposed toward the suction side, the first rib connects the upstream fin at a point disposed between 25% and 60% of a first distance from a first point, the first point being a point on the upstream fin vertically aligned with the pressure side of a cross-section of the airfoil portion taken at a connection with the shroud, the first distance being a distance between the first point and a second point, the second point being the extremity of the upstream fin on the pressure side.

2. The turbine blade as defined in claim 1, wherein the ribs are inner ribs; and further comprising two outer ribs extending outwardly from the outer face, the outer ribs extending from and to the opposed ends of the fins, the inner ribs being disposed between the outer ribs.

3. The turbine blade as defined in claim 2, wherein each of the two outer ribs partially define a contact face on each of the pressure side and suction side.

4. The turbine blade as defined in claim 1, wherein the upstream and downstream fins are inclined relative to a normal to the outer face.

5. The turbine blade as defined in claim 1, wherein the angle formed by the ribs is comprised between 20 and 30 degrees.

6. The turbine blade as defined in claim 1, wherein the ribs include a first rib disposed toward the pressure side and a second rib disposed toward the suction side, the first rib connects the downstream fin at a point vertically aligned with suction side of a cross-section of the airfoil portion taken at a connection with the shroud.

7. The turbine blade as defined in claim 1, wherein the ribs include a first rib disposed toward the pressure side and a second rib disposed toward the suction side, the second rib connects the upstream fin at a point disposed between a vertical alignment of the pressure side and the suction side of a cross-section of the airfoil portion taken at a connection with the shroud.

8. The turbine blade as defined in claim 1, wherein the airfoil portion is twisted along its length.

9. A turbine blade for a gas turbine engine, the blade comprising:

a platform;

a blade root extending radially inwardly from the platform;

an airfoil portion extending radially outwardly from the platform, the airfoil portion defining a pressure side and a suction side of the turbine blade; and a shroud provided at a tip of the airfoil portion opposite to the blade root, the shroud including:

a body having a radially outer face opposite to the airfoil portion;

upstream and downstream fins extending outwardly from the outer face, the fins being generally parallel to each other, each of the fins having an end disposed toward the pressure side and another end disposed toward the suction side;

two ribs extending outwardly from the outer face, the ribs extending from and connecting the upstream fin to the downstream fin at locations other than the ends of the upstream and downstream fins, the ribs converging toward the downstream fin at an angle of between about 10 and about 45 degrees, wherein the ribs include a first rib disposed toward the pressure side and a second rib disposed toward the suction side, the second rib connects the downstream fin at a point disposed between 25% and 60% of a first distance from a first point, the first point being a point on the downstream fin vertically aligned with the suction side of a cross-section of the airfoil portion taken at a connection with the shroud, the first distance being a distance between the first point and a second point, the second point being the extremity of the upstream fin on the suction side.

* * * * *